US006299224B1

(12) United States Patent
Finkelstein

(10) Patent No.: US 6,299,224 B1
(45) Date of Patent: Oct. 9, 2001

(54) PANEL FASTENER

(75) Inventor: Burl Finkelstein, Newnan, GA (US)

(73) Assignee: Kason Industries, Inc., Shenandoah, GA (US)

( * ) Notice: Subject to any disclaimer, the term of this patent is extended or adjusted under 35 U.S.C. 154(b) by 0 days.

(21) Appl. No.: 09/387,469

(22) Filed: Sep. 1, 1999

(51) Int. Cl.[7] ..... E05C 3/04
(52) U.S. Cl. ..... 292/241; 292/240; 52/127.9
(58) Field of Search ..... 52/127.9, 127.7; 292/240, 241

(56) References Cited

U.S. PATENT DOCUMENTS

| | | | | |
|---|---|---|---|---|
| 2,581,816 | * | 1/1952 | Schuleter | 52/127.9 X |
| 3,191,244 | * | 6/1965 | Burke | 52/127.9 |
| 3,400,958 | * | 9/1968 | Haimes et al. | 52/127.9 |
| 3,472,545 | | 10/1969 | Berkowitz . | |
| 3,661,410 | * | 5/1972 | Larson | 52/127.9 |
| 3,671,006 | | 6/1972 | Berkowitz | 249/97 |
| 3,784,240 | | 1/1974 | Berkowitz | 292/111 |
| 4,020,613 | * | 5/1977 | Reynolds et al. | 52/127.9 X |
| 4,417,430 | | 11/1983 | Loikitz | 52/584 |
| 4,507,010 | * | 3/1985 | Fujiya | 52/127.9 X |
| 4,512,122 | | 4/1985 | Berkowitz | 52/127.9 |
| 5,212,924 | | 5/1993 | Finkelstein | 52/583 |
| 6,079,754 | * | 6/2000 | Alexy | 52/127.9 X |

* cited by examiner

*Primary Examiner*—Teri Pham Luu
(74) *Attorney, Agent, or Firm*—Baker, Donelson, Bearman & Caldwell

(57) ABSTRACT

A panel fastener has a casing with two side walls formed with a boss having an outer annular wall that extends reentrantly from an adjacent planar surface of the casing side wall and an inner annular wall with a planar edge recessed from the adjacent casing side wall surface. A cam has a shaft journaled in the boss inner walls that extends out from the boss inner walls. A hook is mounted in camming engagement with the cam whereby the cam shaft is maintained axially aligned in said bosses by their inner wall edges.

1 Claim, 4 Drawing Sheets

PANEL FASTENER

TECHNICAL FIELD

The present invention relates generally to panel fasteners, and particularly to panel fasteners for large insulated panels like those used to form cooler room walls, floors and ceilings.

BACKGROUND OF THE INVENTION

Commercial walk-in coolers, like those commonly found in convenience stores and commercial food storage facilities such as supermarkets, are typically constructed of insulating wall, ceiling and floor panels that are fastened snugly together. The panel ends are shaped to fit together in tongue and groove fashion and are provided with latch type fasteners for drawing and holding adjacent panels together. The latches themselves commonly comprise a hook and cam assembly that is mounted to one panel for latching engagement with a pin that is mounted to an adjacent panel.

There are two main types of panel fasteners, nail-in-place and winged. Both types have a casing with two side walls formed with an annular opening defined by a boss with a curved lip. A cam has a shaft journaled in the boss and a hook mounted in camming engagement with it. Examples of these fasteners are shown in U.S. Pat. Nos. 3,784,240 and 3,671,006, respectively.

A casing boss with a curved lip is fundamentally better than one with a straight lip. However a curved lip renders the casing more susceptible to spreading in the area about the boss. As the hook engages the pin and pulls it, the cam shaft exerts a force on the side of the boss nearer to the pin. As a result, the cam shaft exerts a spreading force on the casing.

This tendency for the casing to spread or bulge is even greater when the latch and pin are misaligned. Winged fasteners are usually mounted by being foamed in place using methods similar to the one shown in U.S. Pat. No. 5,212,924. Foam is injected inside the panel. As it hardens the fasteners become secured in place. Foam hardening often causes the casing of the hook to cock out of mutual alignment. As a result, when the hook engages the pin and pulls on it, the cam shaft pushes against the front of a casing side wall and spreads the hook assembly casing walls apart. The force exerted by the hook on the casing side wall, in combination with the funneling action of the boss, can even cause one side of the cam shaft to pull out of the boss opening and the fastener to malfunction.

The nail-in fastener hook assembly casings also often spread or bulge even though they are mounted to boards usually made of hardened foam. Foam boards are used because they provide good insulation, are inexpensive to manufacture, and are resistant to rotting and water damage. Upon fastening a nail-in panel fastener hook with a pin, the force on the hook often causes the foam board to be crushed or crinkled. This is attributable to the foam board lacking strength sufficient to resist spreading of the metallic walls of the casing. This crushing or crinkling of the foam board often enables the back of the casing to move closer together and the front portion to spread apart. The giving way of the foam board, in combination with the force of the cam shaft against the boss, can easily result in the casing walls spreading significantly. Indeed, the cam shaft may actually become dislodged from the boss resulting in the fastener malfunctioning.

It thus is seen that a need has long existed for a panel fastener hook and cam assembly that is resistant to damage caused during fastening to a complimentary pin assembly. Accordingly, it is to the provision of such that this invention is primarily directed.

SUMMARY OF THE INVENTION

In a preferred form of the invention a panel fastener comprises a casing having two side walls each formed with a boss having an outer annular wall that extends reentrantly from an adjacent planar surface of the casing side wall and an inner annular wall with a planar lip edge recessed from the adjacent casing side wall surface. A cam has a shaft journaled in the boss inner walls that extends out from the boss inner walls. A hook is mounted in camming engagement with said cam. So constructed the cam shaft is maintained axially aligned in the bosses by their inner wall edges. Preferably the inner wall lip edge is recessed a third of the height of the boss from the surface of the surrounding side wall.

BRIEF DESCRIPTION OF THE DRAWING

FIG. 9 is a cross sectional view of a nail-type panel fastener of the prior art while

DETAILED DESCRIPTION

Figure 1:
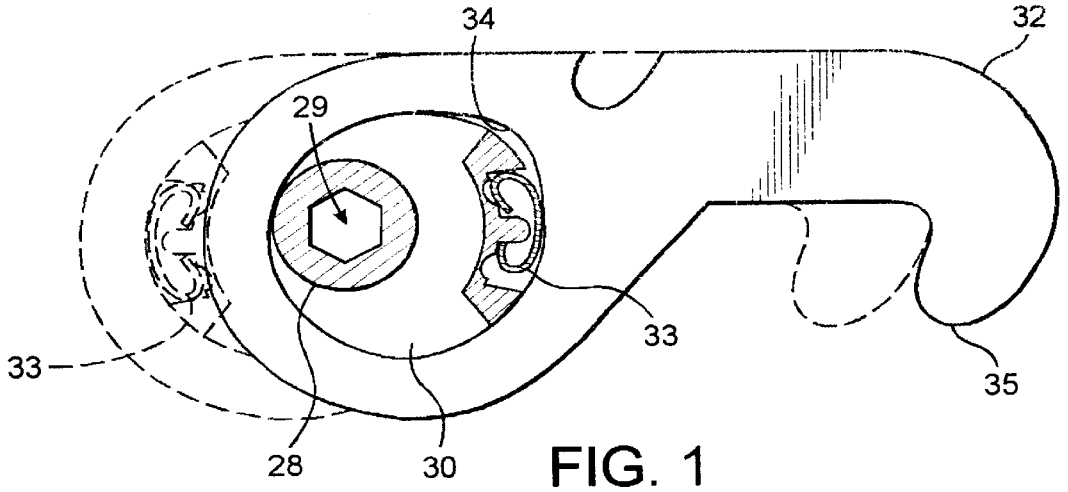
FIG. 1 is a perspective view of a conventional wing type pane fastener with its hook assembly shown disengaged form its complimentary pin assembly.
Figure 2:
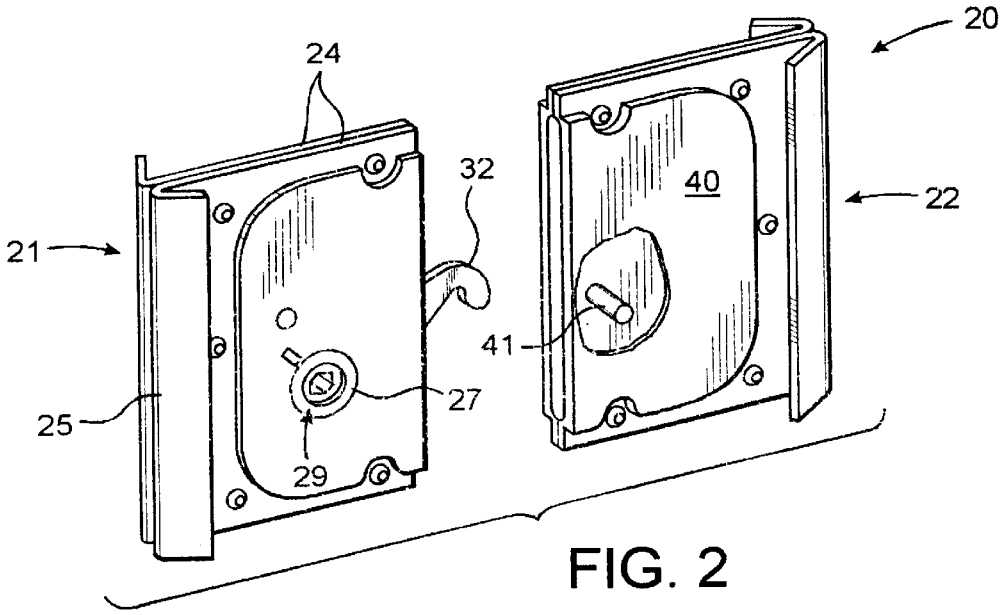
FIG. 2 is a perspective view of the panel fastener of FIG. 1 shown with its hook engaged with its pin.
Figure 3:
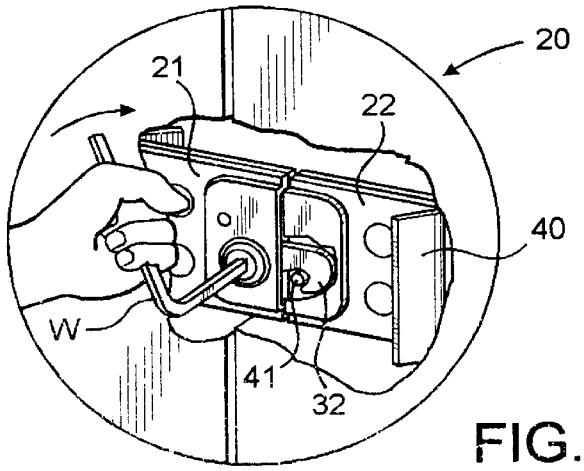
FIG. 3 is a side view, partially in cross section, of a panel fastener hook and cam assembly.

With reference next to the drawings, there is shown in FIGS. 1–5 a conventional wing type panel fastener 20. The fastener has a hook and cam assembly 21 and a pin assembly 22. The hook and cam assembly has a metallic casing comprised of two side walls 24 joined together. Each side wall has a flange 25, hence a wing. Each side wall is formed with a boss 27 through which a cam shaft 28 is journaled. The cam shaft is formed with a socket 29 in which a hand wrench w may be inserted as shown in FIG. 3. The cam shaft protrudes from each side of a disc-shaped cam 30. A hook 32 is mounted in camming engagement with the cam. As best shown in FIG. 1, a C-shaped leaf spring 33 is mounted to the cam in frictional engagement with an inner wall 34 of the hook 32. The catch end 35 of the hook extends out of the casing.

The pin assembly 22 is of similar construction. It too has a winged metallic casing 40 to which a pin 41 is mounted that bridges two side walls of the casing. The pin assembly 22 is foamed in place in a panel in catching alignment with the hook of a hook and cam assembly 21 that has been foamed in place in an adjacent panel.

As best shown in FIGS. 2 and 3, in securing two adjacent panels together the hook 32 is rotated with a wrench w which brings its shank into a position atop the pin. Further rotation of the wrench cams the hook laterally to the position shown in broken lines in FIG. 1. In doing this the catch 35 of the hook engages the pin and then pulls it and the panel to which it is mounted snugly against the panel from which the hook extends.

Figure 4:
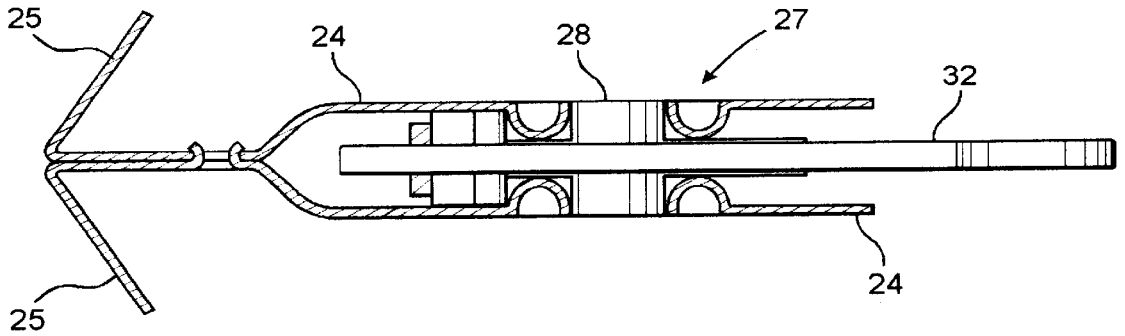
FIG. 4 PRIOR ART
FIG. 4 is a sectional view of a winged type panel fastener of the prior art.
Figure 5:
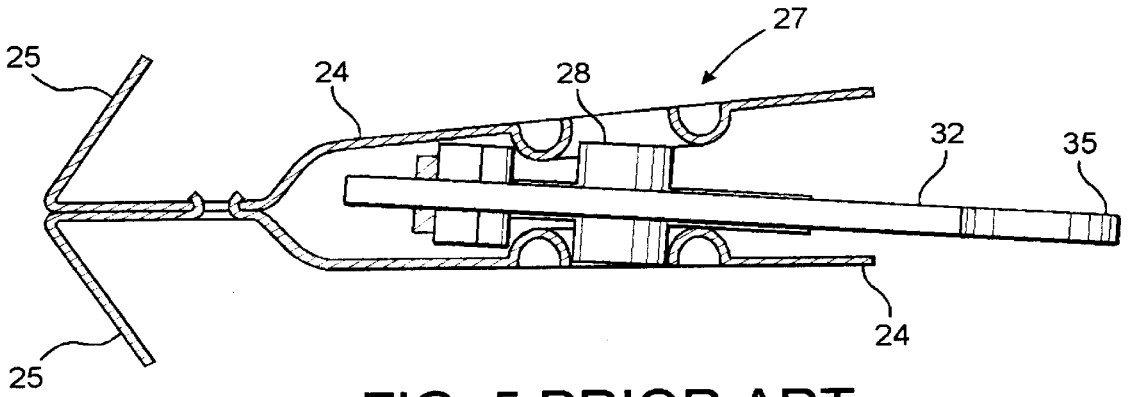
FIG. 5 PRIOR ART
FIG. 5 is a sectional view of the fastener of FIG. 3 shown with its cam shaft being dislodged from its bosses.

A common problem heretofore had with these fasteners is shown in FIGS. 4 and 5. In FIG. 4 the hook is shown aligned properly at a right angle to the casing with the cam shaft 28 extending coaxially with the axes of the two bosses 27. FIG. 5 however shows the result of the hook 32 having engaged and pulled a pin that was misaligned with the hook. Again this can easily occur where the hook and/or the pin have become set as the foam around it hardens at different angles, i.e. where the hook is not normal to the pin. As a result the hook becomes cocked with respect to its casing and bosses as shown in FIG. 5. The extent of this misalignment and force applied is such in FIG. 5 that it is seen that the cam shaft 28 has actually become dislodged from one boss. This results in the panels not being fastened snugly together, at least in the area about this fastener.

Figure 6:
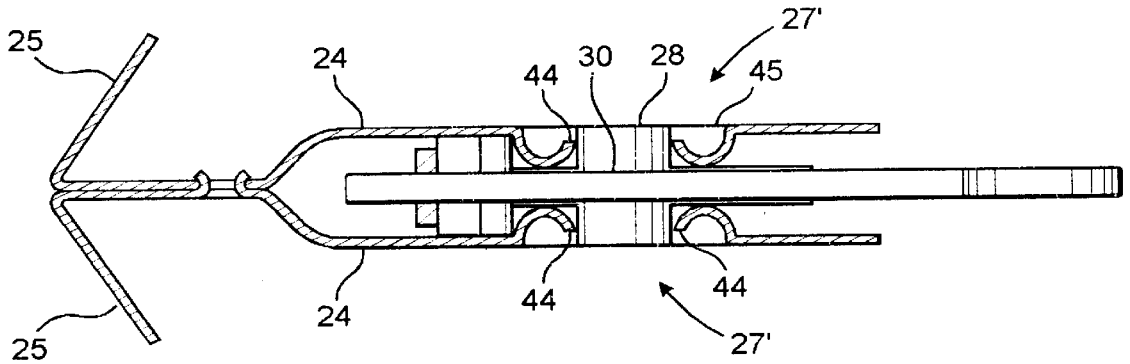
FIG. 6 is a sectional view of a winged panel fastener hook and cam assembly that embodies principles of the present invention.

This problem is basically solved by the new hook and cam assembly shown in FIG. 6. Here it is seen that the boss 27' is formed as a reentrant in each casing side wall 24. It has an outer annular wall and an inner annular wall with an edge 44 of its lip located along a plane substantially parallel to and spaced from the plane 45 of the outer surface of the adjacent portion of the casing side wall. The flat edge thus extends normally from the cam shaft although the annular inner wall itself extends from the shaft at an acute angle thereto. Preferably the edge 44 is recessed one-third of the overall height of the boss, i.e. the distance from the plane 44 to a surface of the bottom of the boss in contact with the cam 30. It has been found that a recess of significantly less than one-third renders poor wear of the cam. Conversely, a recess of significantly more than one-third allows the casings to spread under load.

With the boss lip edge recessed together with the cam shaft 28 extending beyond the lip edge, any cocking of the hook, cam and cam shaft is resisted by the lip edges. Should the cam shaft exert a cocking force on the boss, the lip edges of the boss counteract by biting into the shaft. As a result the cam shaft is forced to maintain axial alignment with the bosses which in turn avoids bulging and spreading of the casing walls about the bosses.

Figure 7:
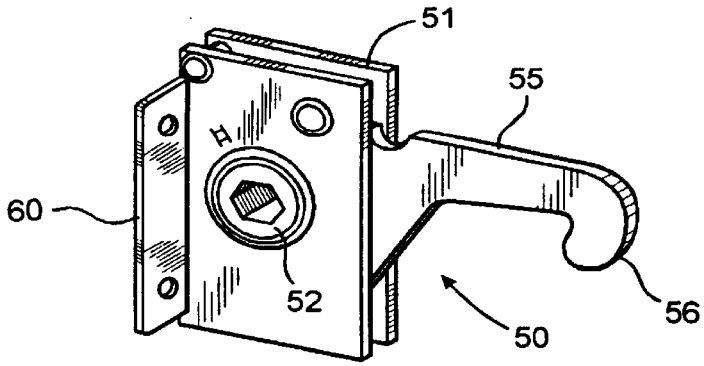
FIG. 7 PRIOR ART
FIG. 7 is a perspective view of a conventional nail-in type panel fastener hook and cam assembly.
Figure 8:
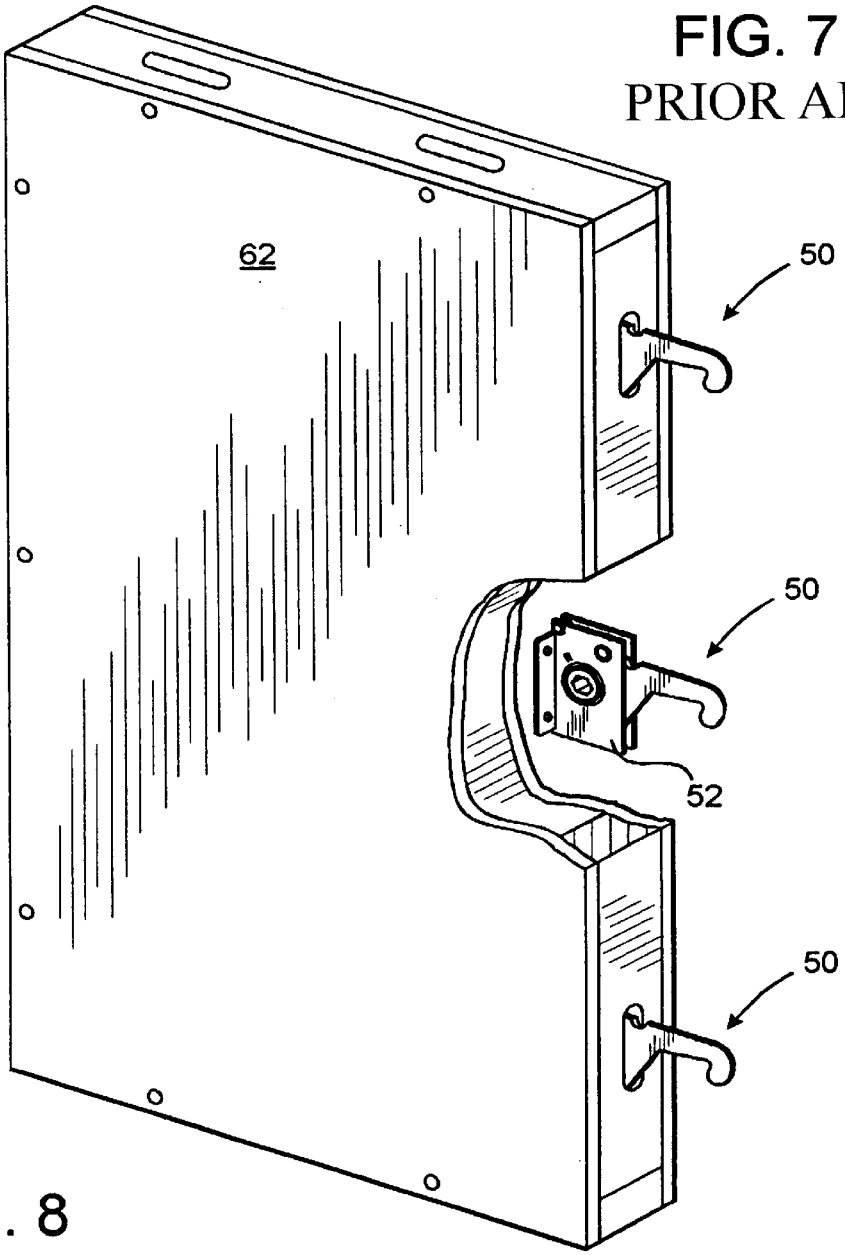
FIG. 8 PRIOR ART
FIG. 8 shows three of the nail-in panel fasteners of FIG. 7 mounted to a board type panel.
Figure 9:
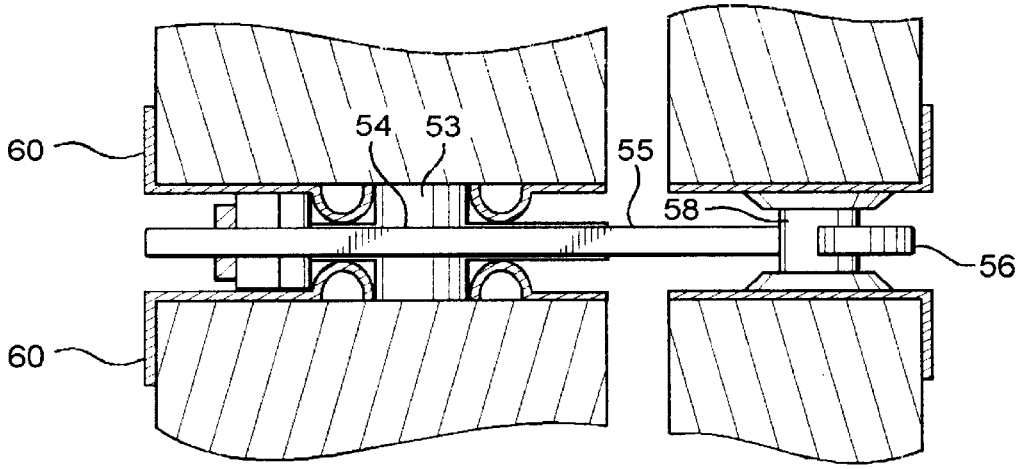
FIG. 9 PRIOR ART

The invention also finds good application in nail-in type panel fasteners. A conventional nail-in panel fastener hook and cam assembly is shown in FIGS. 7, 8 and 9. Again the nail-in type hook and cam assembly 50 has a metallic casing with two side walls 51 with reentrant bosses 52 through which a shaft 53 of a cam 54 is journaled. A hook 55 mounted in camming engagement with the cam extends out of the casing such that its catch 56 may engage and pull a pin 58 of a pin assembly mounted to an adjacent panel. However, rather than the casing having winged flanges, it has two coplanar mounting flanges 60 with holes through which nails may be driven into a panel. The fasteners are mounted to panels 62 as shown in FIG. 8 that have solid frames formed with slots in which the fastener hooks and cam assemblies are mounted. Normally their cam shafts would not extend beyond their casings since that would require lateral recesses to be formed internally in communication with the slots.

Figure 10:
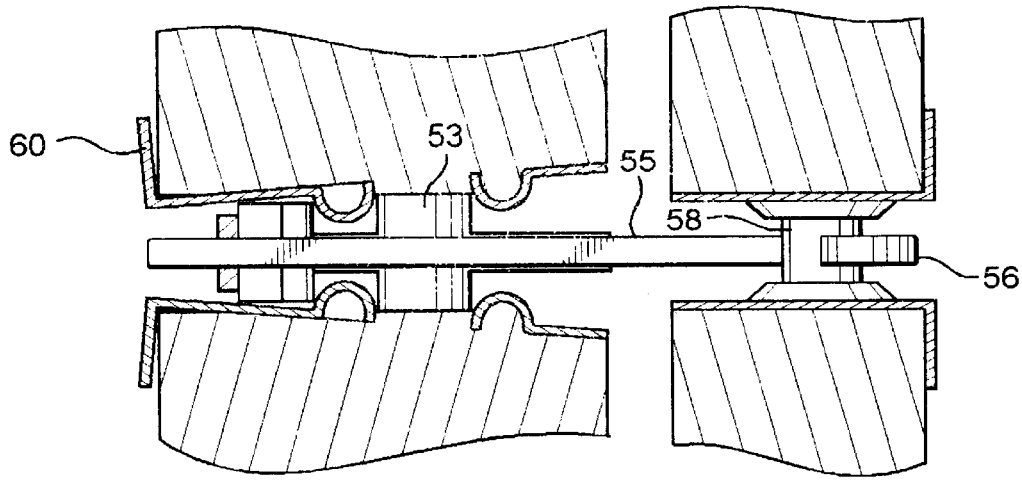
FIG. 10 PRIOR ART
FIG. 10 shows the same fastener with its bosses and adjacent casing spread apart with its cam aft almost dislodged from the bosses.
Figure 11:
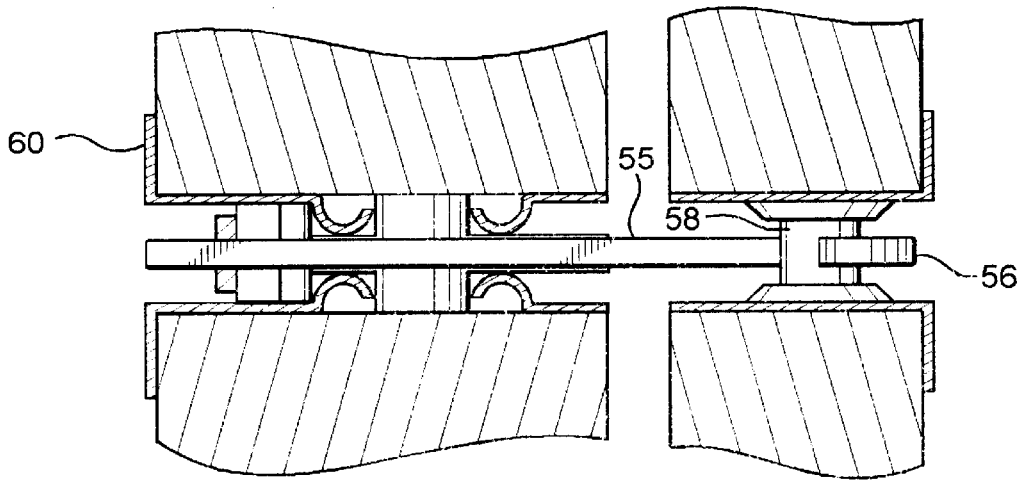
FIG. 11 is a cross sectional view of a nail-in type panel fastener that embodies principles of the present invention.

Again the prior problem is demonstrated in FIG. 10 where it is seen that forces on the cam shaft have caused the casing bosses to spread even though mounted flush to the panel. This can occur because their metal construction is stronger than the panel frame structure which again is usually made of solidified foam. Conversely, with the new bosses shown in FIG. 11 with recessed lips this is avoided even in the presence of cocking forces.

It thus is seen that a new panel fastener hook and cam assembly is provided that overcomes the problem of casing buckling. Although the new assembly has been shown in its preferred form, many modifications, additions and deletions may be made thereto without departure from the spirit and scope of the invention as set forth in the following claims.

What is claimed is:

1. A panel fastener comprising a casing having two side walls each formed with a boss having an outer annular wall that extends reentrantly from an adjacent planar surface of said casing side wall and an inner annular wall with an edge recessed from said adjacent casing side wall surface, a cam having a shaft journaled in said boss inner walls that extends out from said boss inner wall, and a hook mounted in camming engagement with said cam and wherein said outer boss wall extends reentrantly from said adjacent casing wall surface a selected distance and wherein said inner boss wall edge is located approximately one third of said selected distance from said adjacent casing wall surface and extends from said cam shaft at substantially a normal angle thereto, and wherein boss inner wall extends from said cam shaft at an acute angle thereto.

* * * * *